US008457865B2

(12) United States Patent
Geyer

(10) Patent No.: US 8,457,865 B2
(45) Date of Patent: Jun. 4, 2013

(54) METHOD FOR OPERATING AN INTERNAL COMBUSTION ENGINE

(75) Inventor: Klaus Geyer, Sulzbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 427 days.

(21) Appl. No.: 12/801,136

(22) Filed: May 25, 2010

(65) Prior Publication Data

US 2010/0324805 A1 Dec. 23, 2010

(30) Foreign Application Priority Data

Jun. 17, 2009 (DE) ..... 10 2009 025 195

(51) Int. Cl.
*F02D 41/06* (2006.01)

(52) U.S. Cl.
USPC ... 701/104; 701/113; 123/179.7; 123/179.16; 123/179.17

(58) Field of Classification Search
USPC ..... 123/491, 179.7, 179.16, 179.17; 701/103–105, 113
See application file for complete search history.

(56) References Cited

U.S. PATENT DOCUMENTS

| | | | | |
|---|---|---|---|---|
| 5,035,115 | A * | 7/1991 | Ptasinski | 60/712 |
| 5,394,857 | A * | 3/1995 | Yamakawa | 123/686 |
| 5,852,998 | A * | 12/1998 | Yoshioka | 123/491 |
| 6,095,120 | A * | 8/2000 | Neugebauer | 123/478 |
| 6,928,362 | B2 * | 8/2005 | Meaney | 701/115 |
| 7,905,217 | B2 * | 3/2011 | Namari et al. | 123/491 |

FOREIGN PATENT DOCUMENTS

| | | |
|---|---|---|
| DE | 38 41 475 | 6/1990 |

* cited by examiner

*Primary Examiner* — Hai Huynh
(74) *Attorney, Agent, or Firm* — Walter Ottesen

(57) ABSTRACT

An internal combustion engine (1) has a control arrangement (18) which regulates at least one control parameter for operating the engine (1). The control arrangement (18) includes a non-volatile memory (20) and a main memory (21). During operation of the engine (1), an operating value ($x_{Operating}$) for the control parameter is continually stored in the non-volatile memory (20). When starting the engine (1), an initial value for the control parameter is determined. According to at least one criterion, a determination is made as to whether the operating value ($x_{Operating}$) stored in the non-volatile memory (20) or a standard value ($x_{Standard}$) is used as the initial value for the control parameter.

17 Claims, 2 Drawing Sheets

METHOD FOR OPERATING AN INTERNAL COMBUSTION ENGINE

CROSS REFERENCE TO RELATED APPLICATION

This application claims priority of German patent application no. 10 2009 025 195.2, filed Jun. 17, 2009, the entire content of which is incorporated herein by reference.

FIELD OF THE INVENTION

The invention relates to a method for operating an internal combustion engine.

BACKGROUND OF THE INVENTION

DE 38 41 475 discloses a method of operating an internal combustion engine in which the fuel quantity introduced during starting is metered in dependence upon whether it is a cold start or a warm start. For this purpose, the minimum operating time of the internal combustion engine is determined.

It is known to, during operation,control the control parameters of the internal combustion engine, for example, the amount of supplied fuel, in order to achieve an optimal setting of the engine, for example, the air/fuel ratio. Internal combustion engines, for example, in portable handheld work apparatus such as chain saws, cutoff machines, brushcutters, lawn mowers and the like are often operated under the same operating conditions. Therefore, it is advantageous when the current value for the control parameter, which was set by the control arrangement, is retrieved at the next start. In this way, the time before achieving optimal settings of the internal combustion engine can be substantially reduced. When the external operating conditions change, the stored values for the control parameters are no longer optimal, for example, when the operator cleans the air filter and the amount of air supplied is suddenly and markedly increased. With a marked change in operating conditions of the engine, it can take comparatively long before the control arrangement has once again set an optimal value for the control parameter.

SUMMARY OF THE INVENTION

It is an object of the invention to provide a method for operating an internal combustion engine which makes possible a reliable and rapid setting of a control parameter.

The method of the invention is for operating an internal combustion engine with a control arrangement which controls at least one control parameter for controlling the engine. The control arrangement has a non-volatile memory and a main memory. The method includes the steps of: continually storing an operating value ($x_{Operating}$) for the control parameter in the non-volatile memory during the operation of the engine; and, determining an initial value for the control parameter when starting the engine by applying at least one criterion to determine whether the operating value ($x_{Operating}$) stored in the non-volatile memory or a standard value ($x_{Standard}$) of the operating parameter should be used as the initial value.

According to the invention, the corresponding current value for the control parameter is stored in a non-volatile memory. When starting the engine, the last current value can be used as a start value for controlling the control parameter. Additionally, a standard value is stored for the control parameter. From at least one criterion, the control arrangement detects whether the last stored value is no longer optimal as a start value for the control parameter. The control arrangement can then, according to a fixed criterion, use a standard value as the control parameter instead of the stored last current value. The standard value of the control parameter is thereby a default value to which the control parameter is reset.

Advantageously, the criterion is the value of a counter. The counter is advantageously incremented with each starting of the internal combustion engine. In this way, the number of start attempts of the engine can be determined by simple means. The counter is reset to an initial value when at least one operating parameter reaches a limit value during operation. The operating parameter is advantageously the rpm of the engine and the limit value for the rpm is especially between about 10,000 rpm up to about 16,000 rpm. The counter is therefore reset when the rpm reaches a limit value which, for example, can be in the area of the nominal speed of the internal combustion engine. When the engine reaches the nominal speed, the control parameter is set sufficiently well. When the rpm reaches the limit value, it is furthermore ensured that the engine could be started. If the engine can not be started or the necessary rpm could not be reached, for example, as a result of an unfavorable setting of the control parameter, the counter is incremented with every starting of the internal combustion engine.

The standard value for the control parameter is used particularly when the counter exceeds a counter limit value. The counter limit value is about 15 to about 25 times the value of an incrementing of the counter. About 15 to about 25 start attempts can occur during cold start under unfavorable conditions, even with a well set control parameter. If this number of start attempts is exceeded, it can be assumed that the current stored value for the control parameter is unfavorable, for example, because the external conditions have changed. In this case, the standard value is used as the control parameter. Thus, the control arrangement can reset itself to an initial value for the control parameter and thereby create starting conditions that ensure that an optimal value for the control parameter is arrived at in an acceptable time period.

Advantageously, the counter is reset to an initial value when the standard value is used as the control parameter. In this way, it is ensured that after the next start procedure, the last current stored value of the control parameters is again set. Advantageously, predetermined start values are used for the control parameter during the starting procedure of the internal combustion engine. While starting, the control arrangement thus does not retrieve the last current value for the control parameter, but instead retrieves a special start value. In this way, it can be assured that the engine can also be started under unfavorable conditions.

Advantageously, the amount of supplied fuel is a control parameter. Advantageously, the fuel is introduced via a metering valve. Thus, the amount of fuel supplied can be simply and precisely metered. In one embodiment, fuel is introduced into a carburetor. It can, however, be advantageous to introduce the fuel into the crankcase of the internal combustion engine. The engine is especially a single-cylinder engine, advantageously a two-stroke engine. The method according to the invention can, however, also be used to control a single-cylinder four-stroke engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
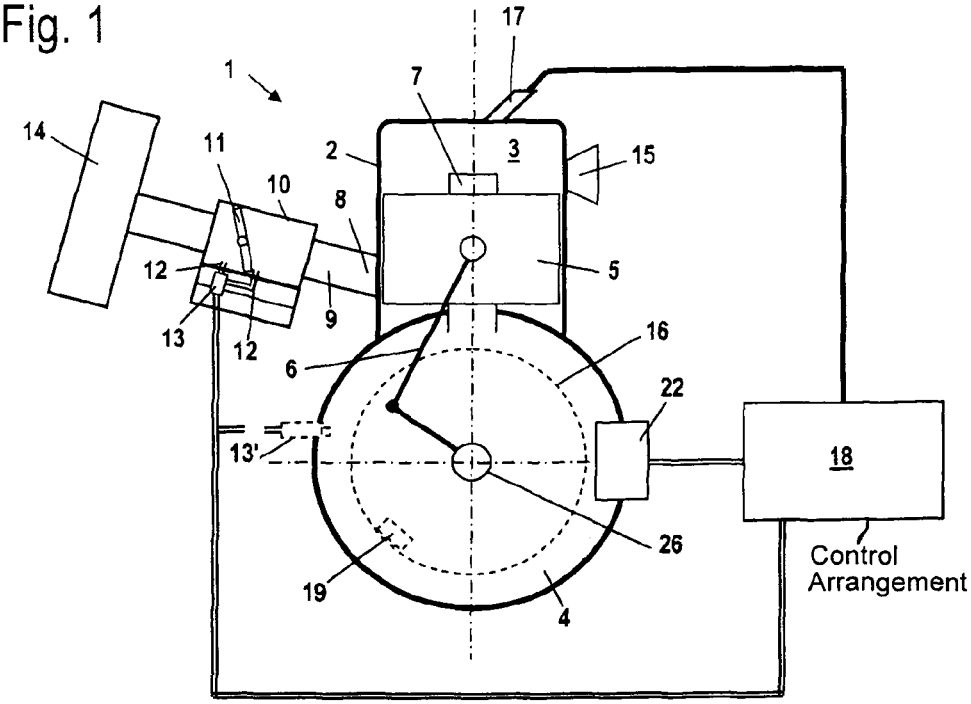
FIG. 1 is a schematic of an internal combustion engine.

The internal combustion engine 1 shown schematically in FIG. 1 is formed as a single-cylinder two-stroke engine. The engine 1 advantageously serves to drive the tool in a portable handheld work apparatus such as a chain saw, cutoff machine, brushcutter, lawn mower or the like. The engine 1 has a cylinder 2 in which a piston 5 is mounted in such a manner that it can move back and forth. The piston 5 delimits a combustion chamber 3 into which a spark plug 17 protrudes. An outlet 15 leads out of the combustion chamber 3. The piston 5 drives a crankshaft 26 rotatably mounted in a crankcase 4 via a connecting rod 6. A fan wheel 16, having at least one magnet 19, is connected to the crankshaft 26 so as to rotate therewith. On the outer periphery of the fan wheel 16, an ignition module 22 is arranged, in which a voltage is induced when the crankshaft 26 rotates. The ignition module 22 supplies a control arrangement 18 and the spark plug 17 with energy. At the same time, the signal of ignition module 22 supplies information about the revolutions per minute of the engine 1.

Instead of or in addition to the ignition module 22, a generator can be provided on the crankshaft 26 for power generation and for generating an rpm signal.

The engine 1 has a inlet 8 into the crankcase 4 which is slot-controlled by the piston 5. At the inlet 8, an intake channel 9 opens which is connected to the clean side of an air filter 14. A carburetor 10 is arranged in the intake channel 9. A throttle flap 11, with which the amount of supplied combustion air is controllable; is pivotally mounted in the carburetor 10. In the carburetor 10, fuel openings 12 open into the intake channel 9. The carburetor 10 has a metering valve 13 for fuel, which is controlled by the control arrangement 18 and via which fuel is supplied into the intake channel 9. A metering valve 13', which supplies fuel directly into the crankcase 4, can also be provided.

During operation of the engine 1, an air/fuel mixture is drawn into the crankcase 4 via the intake channel 9 during the upward stroke of the piston 5. By arranging the metering valve 13' in the crankcase 4, only combustion air is drawn into the crankcase 4 and the fuel is supplied separately via the metering valve 13'. The air/fuel mixture is compressed in the crankcase 4 during the downward stroke of the piston 5 and flows into the combustion chamber 3 via at least one transfer channel 7 which connects the combustion chamber 3 to the crankcase 4 in the region of bottom dead center of the piston 5.

The air/fuel mixture is ignited by the spark plug 17 in the region of top dead center of the piston 5. After combustion, the exhaust gases leave the combustion chamber 3 through an outlet 15. To cool the internal combustion engine 1, a fan wheel 16 is connected to the crankshaft 26 so as to rotate therewith as shown schematically in FIG. 1.

During operation of the engine 1, the control arrangement 18 controls the time point of ignition as well as the amount of fuel supplied. For this purpose, the control arrangement 18 determines the revolutions per minute (n) of the engine 1 from a signal of the ignition module 22. The control arrangement 18 thereby sets the amount of fuel supplied to an optimal value. This is dependent on the load of the engine 1. The amount of fuel to be supplied is also dependent on external ambient influences such as ambient temperature, the temperature of the engine 1 and the temperature of the air drawn in through the air filter 14.

Figure 2:
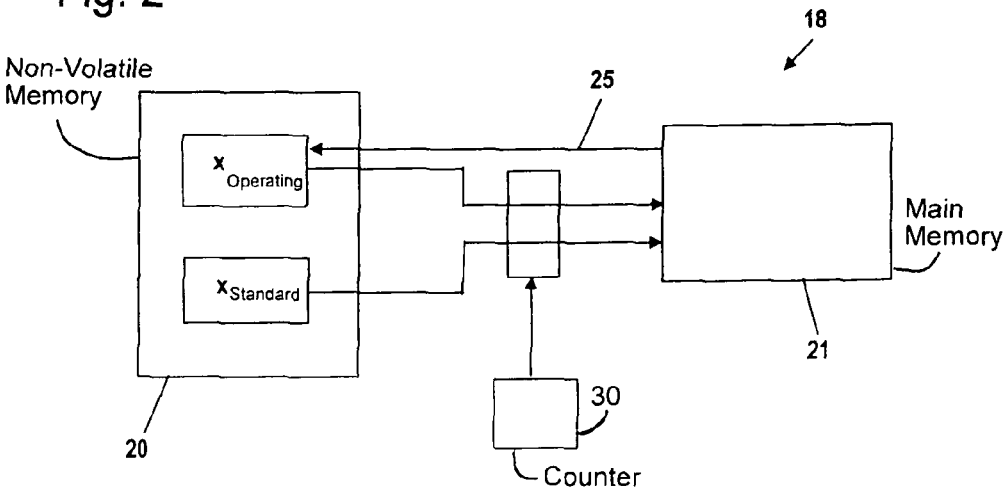
FIG. 2 is a schematic of the control arrangement of the internal combustion engine of FIG. 1.

FIG. 2 shows the configuration of the control arrangement 18 schematically. The control arrangement 18 has a main memory 21, which calculates the current amount of fuel (x) to be supplied from the revolutions per minute and, where appropriate, the load on the engine 1. To calculate the amount of fuel to be supplied, other operating parameters of the engine 1 can also be used such as the pressure in the crankcase 4. To be able to quickly set optimal settings for the amount of fuel to be supplied at the next start of the engine 1, the control arrangement 18 has a non-volatile memory 20, for example, an EPROM, in which an operating value $x_{Operating}$ for the amount of fuel (x) to be supplied is continually saved in memory. The operating value $x_{Operating}$ is usually the last current value. If, however, the current value lies outside of stored limits, then the limit value is stored in memory as the operating value $x_{Operating}$ instead of the current value. This is made clear by the arrow 25. For the next start of the engine 1, the last operating value $x_{Operating}$ for the amount of fuel (x) to be supplied is typically recalled from the non-volatile memory 20 into the main memory 21 and is used as the start value for the amount of fuel to be supplied. If the last operating value $x_{Operating}$ is determined to be an unfavorable value based on a counter 30, then a standard value $x_{Standard}$, which is stored in the non-volatile memory 20, is recalled to the main memory 21 as a starting value for the amount of fuel (x) to be supplied. Whether the standard value $x_{Standard}$ or the operating value $x_{Operating}$ is taken up in the main memory 21 for the amount of fuel (x) to be supplied is decided based on the counter 30.

Figure 3:
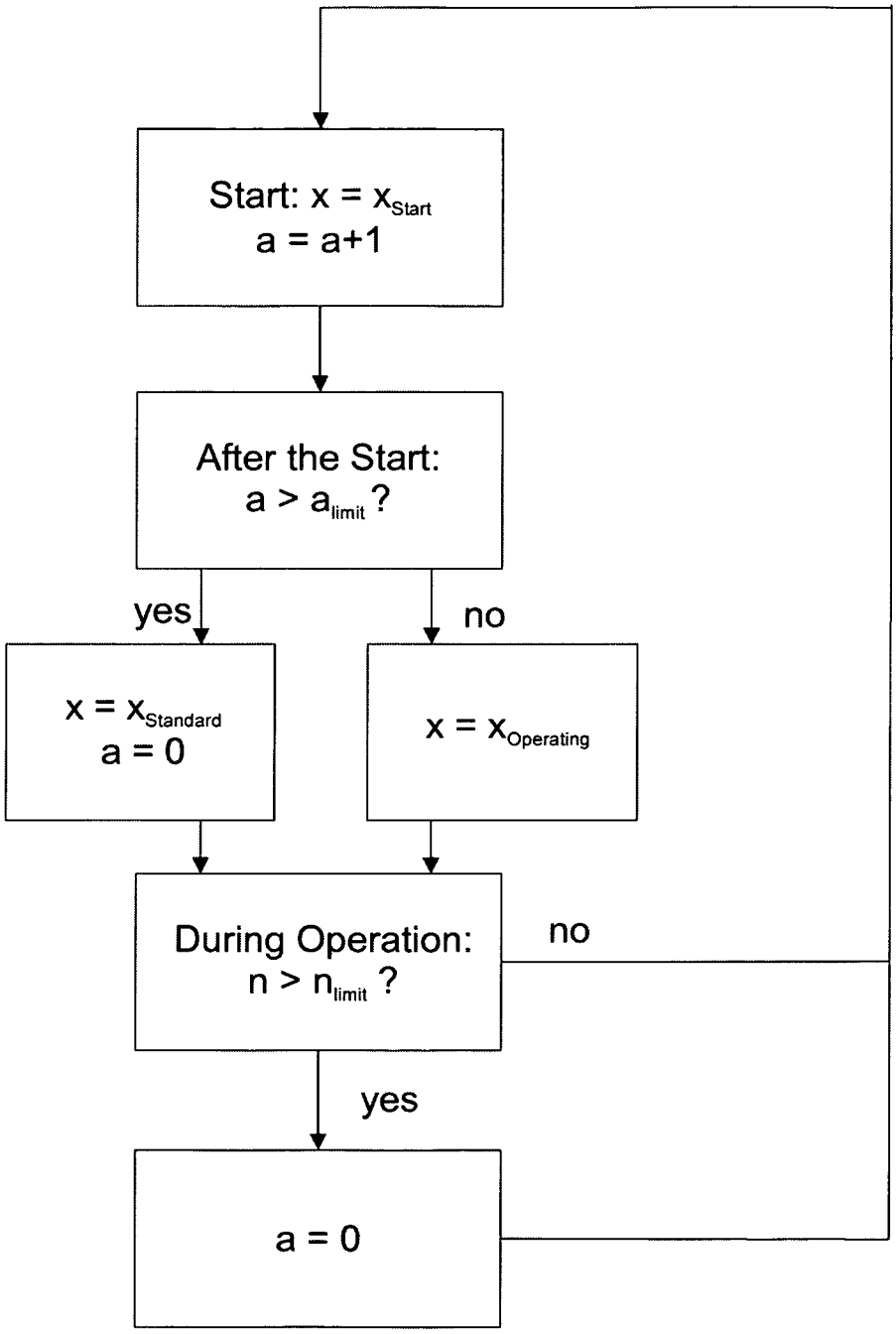
FIG. 3 is a flowchart of the sequence of steps for carrying out the method of the invention.

The sequence of the method is shown in FIG. 3. During start of the engine 1, the amount of fuel (x) supplied is initially set to a start value $x_{Start}$. This ensures that the engine 1 always starts with the same supplied amount of fuel (x). In this way, the starting of the engine 1 can be ensured. During starting of the engine 1, the counter 30 is incremented by one. Whether the counter 30 has exceeded a counter limit value $a_{limit}$ is checked after the start procedure. When the counter 30 is below a counter limit value $a_{limit}$, then the control arrangement 18 loads the operating value $x_{Operating}$, particularly the last current value for the amount of fuel (x), as the initial amount of fuel into main memory 21. If the value of the counter 30 is above a counter limit value $a_{limit}$, the standard value $x_{Standard}$ is loaded into the main memory 21. Then the counter 30 is set to 0. This ensures that the amount of fuel (x) supplied starts with a start value favorable for the engine 1. Beginning with this start value, the control arrangement 18 regulates the optimal value for the amount of fuel (x) supplied. During operation of the engine 1, a check is continuously made as to whether the revolutions per minute (n) of the engine exceed an rpm limit $n_{limit}$. The rpm limit $n_{limit}$ advantageously corresponds to the nominal rotational speed and, as a practical matter, lies between about 10,000 rpm up to about 16,000 rpm. If the revolutions per minute (n) reach the rpm limit $n_{limit}$, the counter 30 is reset to 0. Reaching the rpm limit $n_{limit}$ means that the amount of fuel (x) is set so that the control arrangement 18 can set the optimal value for the amount of fuel (x) in an acceptable amount of time. If the rpm limit $n_{limit}$ is not reached, then the set amount of fuel (x) is very unfavorable so that the control arrangement 18 would take very long to set the optimal amount of fuel (x). In this case, the counter 30 is not reset.

Thus the counter 30 is incremented when the engine 1 does not reach the rpm limit $n_{limit}$ after starting. This is also the case when the start attempt was unsuccessful or when the engine 1 stalls again directly after starting as a result of unfavorable settings. This can, for example, occur with a cold start. The limit value $a_{limit}$ for the counter 30 is advantageously between about 15 up to about 25. A value of about 20 has been shown to be advantageous. If the rpm limit $n_{limit}$ is not reached twenty consecutive times, then the standard value $x_{Standard}$ is loaded into the main memory 21 as the value for the amount of fuel to be supplied at the next start. The standard value $x_{Standard}$ is so chosen that the engine 1 can reach the rpm limit $n_{limit}$. This ensures that the engine 1 can comparatively quickly set the optimal amount of fuel (x) to be supplied in any case even with a marked change in the ambient conditions.

Instead of the amount of fuel (x), other control parameters for the engine 1 can be reset to a start value. This can, for example, be a value for the time point of ignition.

It is understood that the foregoing description is that of the preferred embodiments of the invention and that various changes and modifications may be made thereto without departing from the spirit and scope of the invention as defined in the appended claims.

What is claimed is:

1. A method for operating an internal combustion engine with a control arrangement which controls at least one control parameter for controlling said engine; said control arrangement having a non-volatile memory and a main memory, said method comprising the steps of:

continually storing an operating value ($x_{Operating}$) for the control parameter in said non-volatile memory during the operation of said engine; and, determining an initial value for said control parameter when starting said engine by applying at least one criterion to determine whether said operating value ($x_{Operating}$) stored in said non-volatile memory or a standard value ($x_{Standard}$) of said control parameter should be used as said initial value.

2. The method of claim 1, wherein said control arrangement has a counter having a count and said criterion is said count of said counter.

3. The method of claim 2, wherein said counter is reset to an initial value when at least one operating parameter reaches a limit value ($n_{limit}$) during operation.

4. The method of claim 3, wherein said limit value ($n_{limit}$) for said rpm (n) lies in a range of about 10,000 rpm to about 16,000 rpm.

5. The method of claim 2, wherein said operating parameter is the rpm (n) of said engine.

6. The method of claim 2, wherein said standard value ($x_{Standard}$) is used as the control parameter when said counter exceeds a counter limit value ($a_{limit}$).

7. The method of claim 6, wherein said counter limit value ($a_{limit}$) lies in a range of about 15 to 25 times the value of an increase of said counter.

8. The method of claim 2, wherein said counter is reset to an initial value when said standard value ($x_{Standard}$) is used as said control parameter.

9. The method of claim 1, wherein predetermined start values ($x_{Start}$) are used as said control parameter while starting said engine.

10. The method of claim 1, wherein an amount of fuel is supplied to said engine and a control parameter is said amount of fuel (x) supplied to said engine.

11. The method of claim 10, wherein said fuel is supplied via a metering valve.

12. The method of claim 11, wherein said fuel is introduced into a carburetor.

13. The method of claim 11, wherein said fuel is introduced into a crankcase of said engine.

14. The method of claim 1, wherein said engine is a single-cylinder engine.

15. The method of claim 1, wherein said control arrangement has a counter having a count, said criterion is said count of said counter, the method further comprising the steps of:

incrementing said count of said counter with each start of said combustion engine; and, resetting said count of said counter in dependence upon at least one operating parameter of said combustion engine.

16. A method for operating an internal combustion engine with a control arrangement which controls at least one control parameter for controlling said engine; said control arrangement having a counter having a count which is incremented with each start of said engine and is configured to be reset in dependence upon at least one operating parameter, said control arrangement further having a non-volatile memory and a main memory, said method comprising the steps of:

continually storing an operating value ($x_{Operating}$) for the control parameter in said non-volatile memory during the operation of said engine; and, determining an initial value for said control parameter when starting said engine by applying at least one criterion defined by said count of said counter to determine whether said operating value ($x_{Operating}$) stored in said non-volatile memory or a standard value ($x_{Standard}$) of said control parameter should be used as said initial value.

17. A method for operating an internal combustion engine with a control arrangement which controls at least one control parameter for controlling said engine; said control arrangement having a counter having a count which is changed with each start of said engine and is configured to be reset in dependence upon at least one operating parameter, said control arrangement further having a non-volatile memory and a main memory, said method comprising the steps of:

continually storing an operating value ($x_{Operating}$) for the control parameter in said non-volatile memory during the operation of said engine; and, determining an initial value for said control parameter when starting said engine by applying at least one criterion to determine whether said operating value ($x_{Operating}$) stored in said non-volatile memory or a standard value ($x_{Standard}$) of said control parameter should be used as said initial value.

* * * * *